United States Patent [19]

Imran

[11] Patent Number: 4,777,556

[45] Date of Patent: Oct. 11, 1988

[54] SOLENOID ACTIVATION CIRCUITRY USING HIGH VOLTAGE

[75] Inventor: Mir A. Imran, Palo Alto, Calif.

[73] Assignee: DataTrak, Mountain View, Calif.

[21] Appl. No.: 899,339

[22] Filed: Aug. 22, 1986

[51] Int. Cl.[4] ..... H01H 47/00; H01H 47/32; H01H 9/00

[52] U.S. Cl. ..... 361/155; 361/156; 361/194

[58] Field of Search ..... 361/155, 156, 194, 154

[56] References Cited

U.S. PATENT DOCUMENTS

| | | | |
|---|---|---|---|
| 4,112,477 | 9/1978 | Sherwin | 361/156 |
| 4,318,154 | 3/1982 | De Puy | 361/155 |
| 4,539,619 | 9/1985 | Hill | 361/156 |
| 4,609,780 | 9/1986 | Clark | 361/172 |

*Primary Examiner*—L. T. Hix
*Assistant Examiner*—David Porterfield
*Attorney, Agent, or Firm*—Flehr, Hohbach, Test, Albritton & Herbert

[57] ABSTRACT

Solenoid activation circuitry utilizing a high voltage for energizing a low voltage solenoid from a low voltage source of power comprising a capacitor having first and second terminals with the second terminal being connected to ground. A converter is provided having an input and an output. The input of the converter is adapted to be connected to the low voltage source of power and the output of the converter is connected to the first terminal of the capacitor. A device is provided for sensing the voltage on the first terminal of the capacitor to ascertain when the voltage on the first terminal of the capacitor has reached a predetermined high voltage which is substantially above that of the low voltage of the power source. A switch is provided and is adapted to be connected to the solenoid for causing the capacitor to discharge into the solenoid when the predetermined high voltage has been reached on the capacitor to overcome the initial air gap in the solenoid to move the solenoid to an actuated position.

13 Claims, 2 Drawing Sheets

125 V
30 V

D5
D6
D7
SCR
R9
1K
62
61
SOLENOID
58
56
400uf
C3
D3
D4
10K
R8
66
Q2
Q3
T1
R7
D2
10K
100K
64
R6
100uf
C2
51
52
3 AMP BRIDGE
53
60 ~
24VAC

SOLENOID ACTIVATION CIRCUITRY USING HIGH VOLTAGE

This invention relates to solenoid activation circuitry using high voltage for energizing a low voltage solenoid from a low voltage source of power.

Solenoids have been utilized for actuating many different types of devices, as for example, as in U.S. Pat. No. 4,609,780 wherein solenoids are disclosed for operating latches. In such applications it has been found that it has been difficult to obtain enough energy from a low voltage power source as, for example, a battery to cause operation of the solenoids where significant loads are placed on the solenoids as, for example, by the latches. When this is this case, it is very difficult to obtain operation of the solenoids because where the travel of the solenoid plunger is substantial, the air gap is large making it difficult to obtain sufficient force to move the solenoid to its active position. The same type of problem arises in connection with door and gate solenoid-operated latches which are operated from low voltages. There is therefore a need for new and improved circuitry for operating solenoids from low voltage sources of power.

In general, it is an object of the present invention to provide solenoid activation circuitry which is capable of using high voltage for energizing low voltage solenoids from low voltage sources of power.

Another object of the invention is to provide circuitry of the above character which can supply power at high voltages for relatively short periods of time.

Another object of the invention is to provide circuitry of the above character in a very high impulse force can be obtained from a very small solenoid.

Another object of the invention is to provide circuitry of the above character in which the solenoids can be energized with a high initial impulse to overcome large initial air gaps in solenoids.

Another object of the invention is to provide circuitry of the above character in which power supplies including batteries providing low voltages can be utilized as sources of power.

Another object of the invention is to provide circuitry of the above character in which a low holding current is applied to the solenoid after it has been moved to the activated position to retain it in an activated position.

Another object of the invention is to provide circuitry of the above character in which a relatively short period of time is required for activation of the solenoid.

Another object of the invention is to provide circuitry of the above character which is relatively inexpensive and which can be readily manufactured.

Additional objects and features of the invention will appear from the following description in which the preferred embodiments are set forth in detail in conjunction with the accompanying drawings.

In general, the solenoid activation circuitry utilizing high voltages for energizing a low voltage solenoid from a low voltage source of power consists of a high voltage capacitor having first and second terminals. The second terminal of the capacitor is connected to ground. A voltage converter having an input and an output is provided. The input of the converter is adapted to be connected to the low voltage source of power. The output of the converter is connected to the first terminal of the capacitor. Means is provided for sensing the voltage on the first terminal of the capacitor to ascertain when the voltage on the first terminal has reached a predetermined high voltage substantially above the low voltage of the power source. Switching means is adapted to be connected to the solenoid for causing the capacitor to discharge into the solenoid when the predetermined high voltage has been reached to overcome the initial air gap in the solenoid to move the solenoid into its active position. In an alternative embodiment, means is provided for supplying a low voltage to the solenoid to sustain the solenoid in its active position after it has been moved into its active position.

Figure 1:
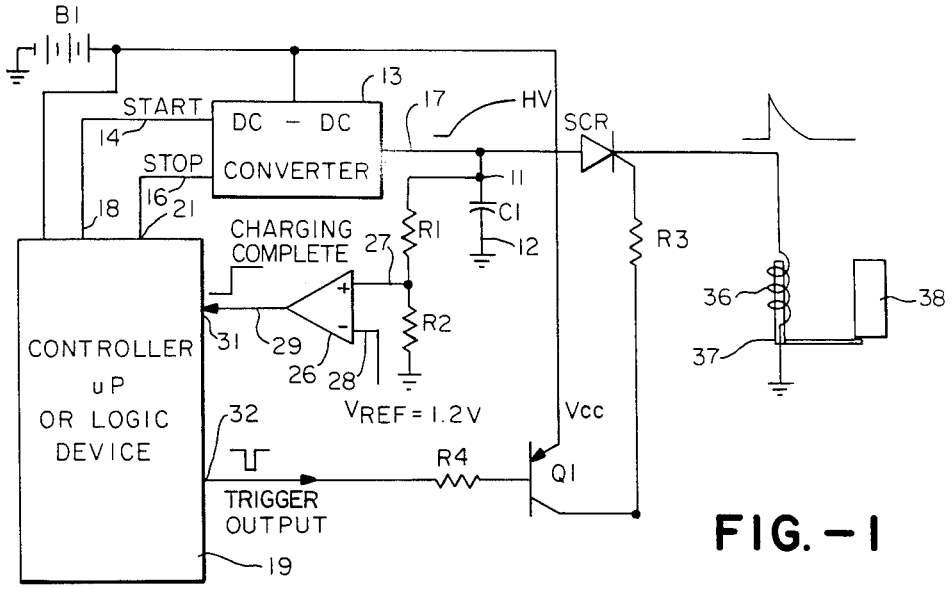
FIG. 1 is a circuit diagram partially in block form showing a solenoid activation circuitry utilizing high voltages incorporating the present invention.

More in particular, the solenoid activation circuitry using high voltage as shown in FIG. 1 consists of a high voltage capacitor C1 which has first and second terminals 11 and 12. As shown, the second terminal is connected to ground. A DC—DC converter 13 is provided which has first and second inputs 14 and 16 and an output 17. The output 17 is connected to the first terminal 11 of the capacitor C1. The input 14 is identified as the "start" input and is connected to the output 18 of a conventional controller, microprocessor or other type of logic device 19. The other input 16 identified as the "stop" input is connected to the output 21 of the controller 19. As shown, the DC to DC converter 13 and the controller 19 are supplied with a positive voltage from the low voltage battery B1 having a voltage Vcc of 3–6 volts which has its negative terminal connected to ground. The DC to DC converter 13 converts the low DC voltage of 3–6 volts to a suitable high voltage HV such as 120–130 volts DC.

Means is provided for measuring the voltage appearing on the first terminal 11 of the capacitor C1 and supplying that information to the controller 19 and consists of a comparator 26 of a conventional type which has positive and negative inputs 27 and 28 with the negative input being connected to a suitable voltage reference as, for example, a reference voltage of 1.2 volts. The positive input terminal 27 is connected into a voltage divider network consisting of resistors R1 and R2 connected in series. One end of the resistor R2 is connected to ground and the other end is connected to the positive terminal 27. One end of the resistor R1 is connected to the positive terminal 27 and the other end of the resistor R1 is connected to the first terminal of the capacitor 11. The output 29 of the comparator 26 is connected to the controller 19 and advises the controller 19 when the charging of the capacitor C1 is complete by comparing the voltage which is received on the input line 27 with the voltage on the reference 28 and supplying a signal on the output 29 to the input 31 of the controller 19. The controller 19 when it receives "charge complete" information supplies an output signal on its output 32 and at the same time supplies a "stop" signal to the DC to DC converter 13. The signal provided on the output 32 of the controller 19 serves as a trigger signal for operating a trigger circuit consisting of the transistor Q1, but by supplying the signal to the base of the transistor through a current limiting resistor R4. The positive battery voltage Vcc is supplied to the emitter of the transistor Q1 which upon receiving the trigger signal supplies a signal on its collector the coupling resistor R3 to trigger a switching device such as a silicon controller rectifier (SCR) which then permits the capacitor C1 to discharge through the SCR and through the winding 36 to ground. This causes actuation of the solenoid to cause movement of the plunger 36 from the first or inactive to a second or active position to operate a latch 38. It should be appreciated that the switching device also can be in the form of a electromechanical relay or other types of semiconductor switches such as bipolar and field effect transistors.

It has been found that by utilizing circuitry of the type shown in FIG. 1 that large amounts of power can be supplied to low voltage solenoids for relatively short periods of time to obtain very high forces from small solenoids. This is true because most solenoids that are rated, for example, from 3 to 120 volts can withstand 10 to 20 times their continuous voltage rating for very short periods of time. This is possible because the heating effect due to this power dissipation, due to the power dissipation in accordance with $I^2 R_s$ where I is the current through the solenoid and $R_s$ is the solenoid internal resistance, is minimal when the duration of the pulse of energy supplied is very short as, for example, 10 to 100 milliseconds. By utilization of the DC to DC converter, the capacitor C1 can be charged to a high voltage from a very low voltage source. The stopping and starting of the charging of the capacitor C1 by the DC to DC converter is controlled by a controller 19 by a microprocessor or other logic device. When the capacitor C1 is charged, the controller 19 causes the silicon controlled rectifier (SCR) to be turned on to discharge the capacitor into the solenoid coil or winding to cause activation of the solenoid.

By way of example, it has been found by utilizing circuitry of the present invention it is possible to operate latches requiring a high pulling force from low voltage solenoids rated at approximately three volts from a battery of approximately 4.5 volts. By charging the capacitor C1 up to a high voltage as, for example, 70 to 80 volts, it is found that discharging this capacitor into the solenoid through the electronic switch, the high voltage SCR, a large impulse force is provided by the solenoid on the order of 7 to 10 pounds. This is in comparison to a force of approximately 1/10th of a pound when the solenoid was merely energized directly from a battery of 4.5 volts.

The DC to DC converter is a fly-back converter which takes the battery voltage and by utilizing a step up transformer converts it to a higher voltage which is then rectified and used to charge up the high voltage capacitor. In the present example, the total amount of energy which was delivered to the solenoid by the capacitor after it has been charged was found to be approximately 0.7 Joule. It was found that this 0.7 Joule energy from the capacitor was delivered in approximately 30 milliseconds to apply approximately 23 watts of peak power. It also was found that by discharging the energy from the capacitor into the solenoid very rapidly as, for example, in 30 milliseconds, 80 volts could be applied to the solenoid winding without causing any damage to the solenoid even though it was rated for only three volts. Such low voltage solenoids can tolerate the high voltages from the capacitor because the windings on such solenoids are capable of withstanding much higher voltage as, for example, several hundred volts, as long as the energy supplied to the solenoid is of short duration so as to create very little heat which could destroy the insulation provided on the windings. The waveforms appearing in various portions of the circuit are shown in FIG. 1.

Figure 2:
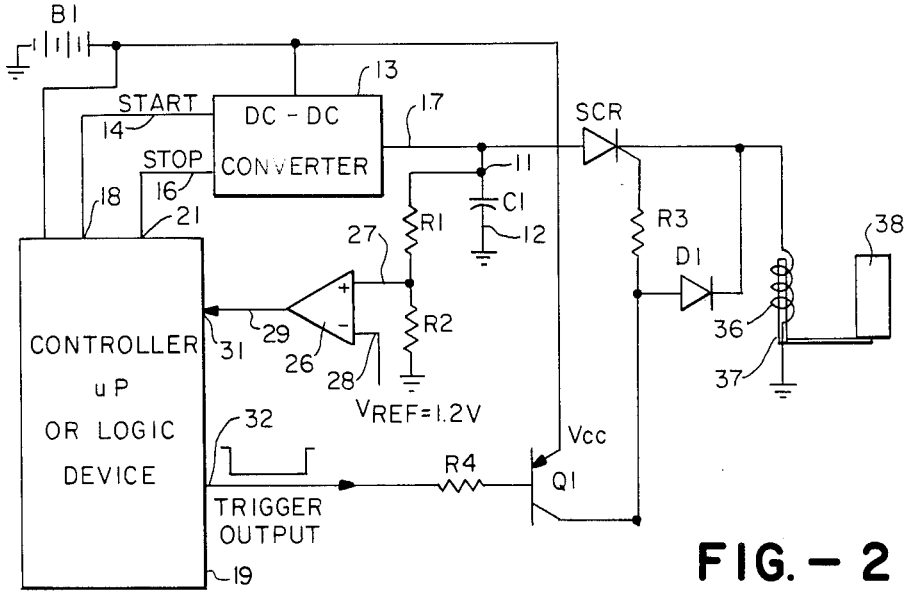
FIG. 2 is an alternative embodiment of the circuitry shown in FIG. 1.

In connection with FIG. 1 it should be appreciated that the circuitry is one in which a power input pulse of short duration is supplied for actuation of the solenoid. After the power pulse has been dissipated, the solenoid normally returns to its normally inactivated position. When it is desired that the solenoid be retained in its activated position, circuitry such as shown in FIG. 2 can be utilized. As can be seen from FIG. 2, the circuitry is very similar to that shown in FIG. 1 with the exception that diode D1 is connected between the collector of the transistor Q1 and the output of the SCR which is also the input of the solenoid coil 36.

Figure 3A:
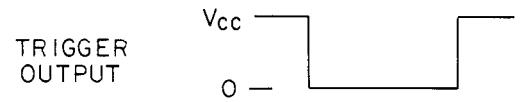
FIG. 3A is a curve showing the trigger output.
Figure 3B:
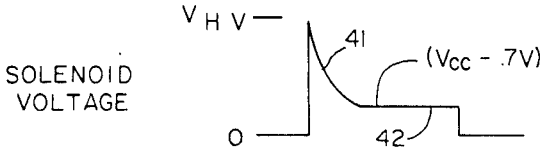
FIG. 3B is a curve showing the voltage applied to the solenoid.

In operation of this embodiment of the invention, the capacitor C1 is discharged into the solenoid coil 36 in a similar manner under the control of the microprocessor 19 to cause movement of the solenoid plunger to an actuated position to actuate a latch or other device. However means is provided for retaining the solenoid plunger in an actuated position after the capacitor C1 has been discharged again under the control of the microprocessor. This is indicated by the much longer waveform of the trigger output 32 from the microprocessor in comparison to the very short trigger output shown in FIG. 1. The longer trigger output keeps the transistor Q1 turned on which causes battery power to be supplied from the collector of the transistor Q1 through the diode D1 and to the solenoid 36. It has been found that this voltage is sufficient to retain the solenoid plunger in the actuated position. It is retained in this actuated position until the trigger output signal turns the transistor Q1 off at which time the solenoid plunger will return to its normal unactuated position. It has been found that with such circuitry, the voltage from the capacitor C1 can be utilized to supply a sufficient current at high voltage to cause operation of the solenoid so that when the air gap in the solenoid is large and to thereafter provide sufficient voltage from the battery to sustain the solenoid in its active position. This normally can be readily accomplished with appropriate battery voltages and solenoid ratings which are adequate to sustain the mechanical load placed on the solenoid. The longer waveforms which are required for this type of operation are shown in FIGS. 3A and 3B with 3A showing the length of the waveform for the trigger output and FIG. 3B showing the voltage applied to the solenoid coil with the peak 41 representing the point in time when the high voltage is applied to the solenoid coil by discharge of the capacitor C1 and with the plateau 42 representing the voltage being applied to the solenoid coil during the time when the voltage is being supplied directly from the battery through the diode D1.

Figures 4, 5:
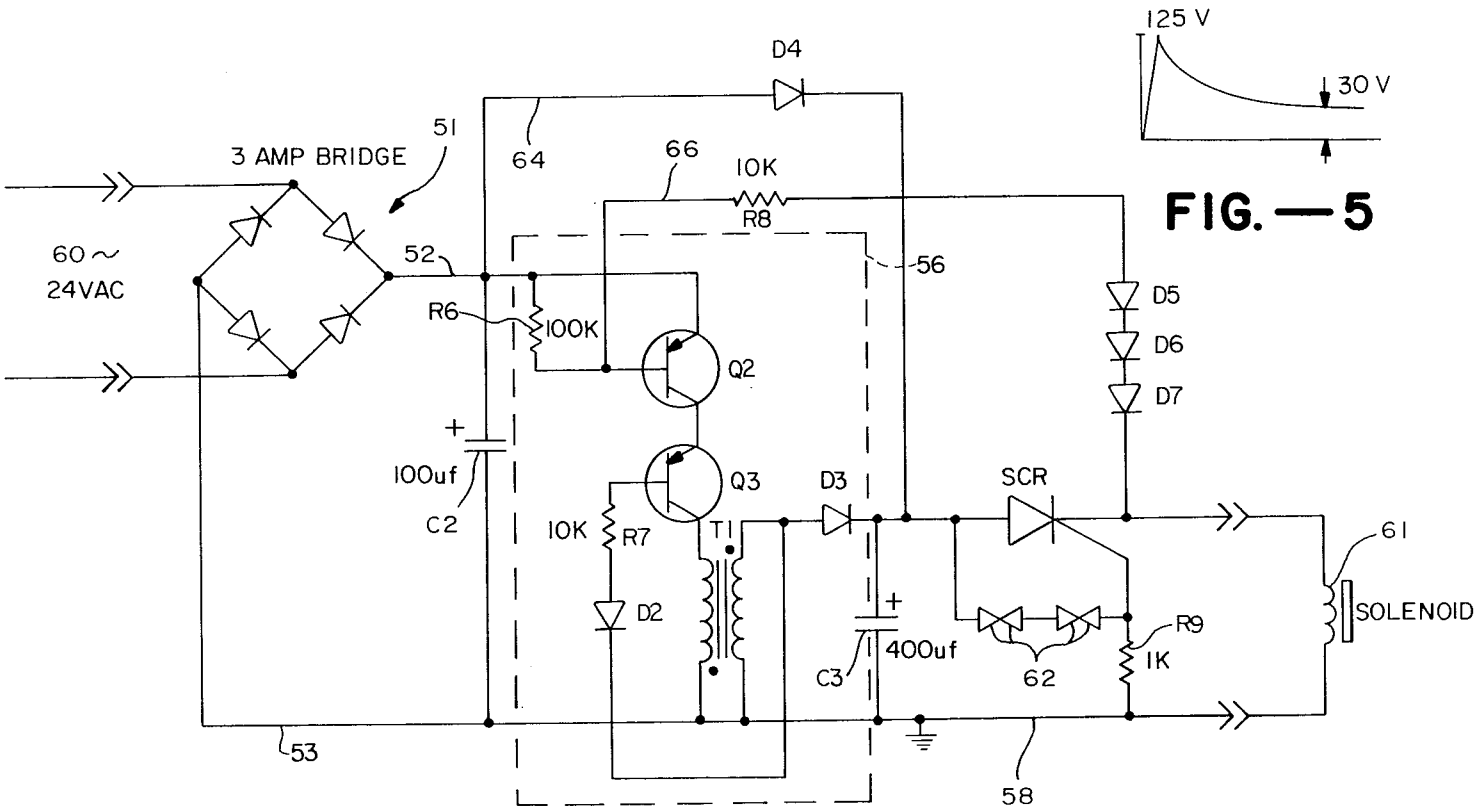
FIG. 4 is a circuit diagram showing still another embodiment of the present invention particularly suited for use in solenoid-operated door and gate latches.
FIG. 5 is a curve showing the voltage applied to the solenoid shown in FIG. 4.

Still another embodiment of the present invention is shown in FIG. 4 which is particularly applicable for use in the operation of door and gate latches. As shown therein, it is adapted to be operated from a suitable AC source of power as, for example, 24 volts 60 cycle AC as indicated. This 24 volts AC is supplied to opposite sides of a conventional full wave Wheatstone bridge rectifier 51. The opposite sides of the rectifier 51 are connected to output leads 52 and 53 which are connected across a capacitor C2 of a suitable value such as 100 microfarads to filter the full wave output from the rectifier 51. The output lines 52 and 53 of the rectifier 51 are connected to a DC to DC converter 56. The line 52 is connected through a resistor R6 of a suitable value as, for example, 100K ohms to the base of a transistor Q2 and is also connected to the emitter of the transistor Q2. The emitter of the transistor Q2 is connected to the emitter of the transistor Q3. The base of the transistor Q3 is connected through a resistor R7 and a diode D2 to one side of a secondary winding of a transformer T1. The diode D2 is also connected to a diode D3 and the diode D3 is connected to an output line 57 for the DC to DC converter. The collector of the transistor Q3 is connected to one side of the primary winding of the transformer T1. The line 53 from the rectifier 51 is connected to the one side of the primary winding and also one side of the secondary winding of the transformer T1. It is also connected to the output line 58 for the DC to DC converter 56.

The high voltage output lines 57 and 58 from the DC to DC converter 56 are connected across a high voltage capacitor C3. The line 57 is also connected to one side of an SCR which is adapted to be connected to one end of the winding 61 of a solenoid. Four Zener diodes 62 of a suitable type such as HT32 are connected across the SCR. The gate of the SCR and the Zener diodes are connected through a resistor R9 to the output line 58. The resistor R9 serves to provide a path to ground for both the gate of the SCR and to supply a ground reference for the Zener diodes 62. The Zener diodes 62 have been connected in series to provide a predetermined trigger voltage for the SCR. Thus by way of example, if each of the Zener diodes 62 has a breakdown voltage of approximately 30 volts, four such Zener diodes connected in series can be utilized to provide a breakdown voltage of approximately 120 volts. If a lower breakdown voltage or conversely if a higher breakdown voltage is desired, fewer or more of the Zener diodes can be placed in series. The line 52 is also connected to a line 64 that is connected to a diode D4 which is connected by a line 66 to the input of the SCR. The DC to DC converter 56 is also provided with an output line 66 which is connected to the side of the resistor R1 connected to the base of the transistor Q2 and is connected through a resistor R8 of a suitable value such as 10K ohms through three serially connected diodes D5, D6 and D7 that are connected to the gated output of the SCR connected to one side of the winding 61.

Operation of the circuits shown in FIG. 4 may now be briefly described as follows. Let it be assumed that a suitable source of voltage as, for example, 24 volt 60 cycle AC is supplied to the bridge rectifier 51. As soon as this occurs, full wave rectified, filtered DC is supplied to the DC to DC converter 56 to cause a high voltage AC to be supplied from the transformer T1 through the diode D3 to the high voltage capacitor C3 so that it commences charging as soon as voltage is supplied to the rectifier 51.

When the voltage on the capacitor C3 reaches a predetermined value as predetermined by the Zener diodes 62, the SCR is triggered which causes the voltage across the capacitor C3 to be applied to the solenoid winding 61.

As the capacitor C3 discharges through the SCR, and reaches the voltage that is applied to its input terminals as, for example, approximately 30 volts DC, the diode D4 begins conducting and supplies the voltage available from the output from the rectifier 51 to the solenoid winding 61 through the SCR. Since the output of the SCR has a voltage approximately one volt less than the input voltages, this back biases the three diodes in series, diodes D5, D6 and D7 which in turn turn the DC to DC converter 56 off. The cycle is then ready to be recommenced, when the 24 volt 60 cycle AC input signal is removed and reapplied.

It can be seen that there has been provided a circuit which automatically turns on and off with the sequence of charging of the high voltage capacitor C3 in the circuit, delivery of a high voltage pulse from the capacitor C1 and thereafter supplying a low voltage continuous pulse and turning off the DC to DC converter without the necessity of employing a complicated controller circuit. The three diodes D5, D6 and D7 have been utilized in series so as to generate a voltage which is equal to or greater than the input voltage in order to turn off the transistor Q2 and place the DC to DC converter 56 in an inoperative condition. In order for the circuit to operate the voltage drops across the diodes D5, D6 and D7 must be equal to the voltage drop across the diode D1 and the SCR. The resistor R8 of a suitable value such as 10,000 ohms serves as a current limiting resistor for the transistor Q2 which controls the transistor Q3. The transistor Q2 is utilized as a power switch to supply power to the transistor Q3 which supplies high frequency, i.e., 50 KHz low voltage alternating current to the primary winding of the transformer T1. The secondary of the transformer T1 supplies high voltage high frequency AC to the diode D2. The diode D2 rectifies the high voltage high frequency AC to supply high voltage DC to charge the capacitor C1. The DC to DC converter 56 is a conventional flyback type design converter in which the windings of the transformer T1 are such that the output of the transformer T1 is opposite in winding polarity to that of the winding polarity of the input which helps the transistor Q3 to turn on and off as the transformer T1 goes into and out of saturation.

The voltage which is obtained from the circuitry shown in FIG. 4 for driving the solenoid is shown in FIG. 5. Thus as shown, after a predetermined interval, a high voltage HV, as for example, 125 volts is produced which rapidly decays to a predetermined lower voltage as, for example, 30 volts. This lower voltage is maintained until there is a complete power cutoff to the circuitry which is shown in FIG. 4.

The circuitry shown in FIG. 4 has numerous applications. For example, it is particularly adaptable for use in opening latches for doors and gates. For example, if it is desired to control the opening and closing of such gates in accordance with a time clock, the time clock can be utilized for supplying power to the circuitry which is shown in FIG. 4. As soon as power is supplied and after the capacitor C3 is charged, high voltage is supplied to the solenoid for the latch which causes the solenoid to produce a large force which can be used to overcome a large air gap which may be present in the latch mechanism to open the latch mechanism. As soon as the latch mechanism has been opened by this initial high voltage pulse, the latch mechanism can be retained in an open position by the lower voltage placed on the solenoid, as for example, the 30 volts shown in FIG. 5. This lower voltage can be maintained on the latch mechanism for a predetermined interval of time, as for example, determined by time clock to maintain the latch in an open position so that the door or gate can be opened throughout that time period. After the time period has elapsed and the time clock stops supplying energy to the circuit in FIG. 4, the spring force normally present in the latch mechanism will move the latch mechanism to its normally closed position since the solenoid is no longer energized. When the time clock again supplies energy to the circuitry shown in FIG. 4, the same sequence of operations will take place in which an initial high voltage pulse is supplied to the solenoid and thereafter a low continuous voltage is supplied to the solenoid. The use of such a low voltage reduces the current drain for operating the solenoid. In addition, it ensures that the solenoid will not be damaged by undue heat, even though it is energized for long periods of time.

In the event of power failure, the circuit shown in FIG. 4 will still function properly. Thus in the event of a power failure, the latches will close. However, as soon as power is restored, the latches will again be opened under the control of the circuitry in FIG. 4 assuming that the time clock settings provide for a voltage to be supplied to the circuitry shown in FIG. 4.

It is apparent from the foregoing that there has been provided solenoid activation circuitry which utilizes high voltages for energizing a low voltage solenoid from a low voltage source and for also sustaining the actuation of the solenoid from a low voltage source. The circuitry is of the type which can be utilized with the low voltage solenoids without danger of damaging the same. The circuitry is such that very high forces can be obtained from very small solenoids. The circuitry is such that it can be made relatively inexpensively and very compact.

What is claimed is:

1. In a solenoid activation circuitry utilizing a low voltage source of power and providing a high voltage for energizing from a low voltage source of power a low voltage solenoid a coil with a movable plunger therein movable between actuated and deactuated positions and forming an air gap representing the required travel of the plunger, a high voltage capacitor having first and second terminals, means connecting the second terminal to ground, a converter having input and an output, the input being adapted to be connected to the low voltage source of power and the output being connected to the first terminal of the capacitor, means for sensing the voltage on the first terminal of the capacitor to ascertain when the voltage on the first terminal of the capacitor has reached a predetermined high voltage which is substantially above that of the low voltage of the power source and substantially above the low voltage normally applied to the solenoid and means connected to the solenoid for causing the capacitor to discharge into the solenoid when the predetermined high voltage has been reached on the capacitor to overcome the air gap in the solenoid to move the plunger into an actuated position and means for supplying a low voltage from the low voltage source of power to the solenoid to sustain the solenoid in the actuated position after it has been moved to the actuated position.

2. Circuitry as in claim 1 wherein said converter is a DC to DC converter.

3. Circuitry as in claim 2 wherein low voltage source of power is a DC source.

4. Circuitry as in claim 2 wherein said low voltage source is an AC source.

5. Circuitry as in claim 4 together with rectifier means connected to the AC source to provide a DC output.

6. Circuitry as in claim 1 wherein said means for sensing the voltage on the first terminal of the capacitor includes a comparator.

7. Circuitry as in claim 1 wherein said switching means adapted to be connected to the solenoid for causing the capacitor to discharge into the solenoid includes a switching device and means for triggering the switching device.

8. Circuitry as in claim 7 wherein said means for supplying a lower voltage to the solenoid includes a diode.

9. Circuitry as in claim 8 wherein said means for triggering the switching device includes a transistor and wherein the output of the transistor is connected through the diode.

10. Circuitry as in claim 7 wherein said switching device is a silicon controlled rectifier.

11. Circuitry as in claim 10 wherein said means for triggering comprises at least one Zener diode connected across said silicon controlled rectifier.

12. Circuitry as in claim 2 together with means for switching the DC to DC converter to an inoperative condition.

13. Circuitry as in claim 12 wherein the means for switching the DC to DC converter to an inoperative condition includes serially connected diodes connected between the input and the output of the switching means.

* * * * *